US007207122B1

(12) United States Patent
Ellis

(10) Patent No.: US 7,207,122 B1
(45) Date of Patent: Apr. 24, 2007

(54) APPARATUS AND PROCESS FOR APPLYING LAP SIDING

(76) Inventor: Wayne J. Ellis, 24823 Norris La., Junction City, OR (US) 97448

( * ) Notice: Subject to any disclaimer, the term of this patent is extended or adjusted under 35 U.S.C. 154(b) by 439 days.

(21) Appl. No.: 10/909,239

(22) Filed: Jul. 29, 2004

(51) Int. Cl.

| | |
|---|---|
| ***G01D 21/00*** | (2006.01) |
| ***E04D 15/00*** | (2006.01) |
| ***E04F 21/00*** | (2006.01) |
| ***E04G 21/14*** | (2006.01) |
| ***E04G 21/00*** | (2006.01) |
| ***E04G 23/00*** | (2006.01) |
| ***E04B 1/00*** | (2006.01) |

(52) U.S. Cl. ..... 33/647; 52/749.1; 52/748.1; 52/741.13

(58) Field of Classification Search ..... 33/646, 33/647, 648, 649; 269/904; 52/DIG. 1, 52/748.1, 747.1, 741.13, 749.1, 749.11, 749.12
See application file for complete search history.

(56) References Cited

U.S. PATENT DOCUMENTS

| | | | | | |
|---|---|---|---|---|---|
| 216,252 | A | * | 6/1879 | Allison | 33/647 |
| 248,460 | A | * | 10/1881 | Harris | 33/411 |
| 631,315 | A | * | 8/1899 | Meskill | 33/647 |
| 844,612 | A | | 2/1907 | Morris | |
| 2,889,632 | A | | 6/1959 | Longhi | |
| 3,792,852 | A | * | 2/1974 | Reniker | 269/95 |
| 4,473,100 | A | * | 9/1984 | Wheeler | 81/45 |
| D324,345 | S | * | 3/1992 | Demoulpied et al. | D10/64 |
| 5,335,423 | A | | 8/1994 | McLaughlin | |
| 5,370,377 | A | | 12/1994 | Van Der Meer | |
| 5,692,311 | A | * | 12/1997 | Paquin | 33/647 |
| 6,928,743 | B1 | * | 8/2005 | Marshall | 33/648 |

* cited by examiner

*Primary Examiner*—Robert Canfield
*Assistant Examiner*—Hunter Dreidame
(74) *Attorney, Agent, or Firm*—Robert E. Howard

(57) ABSTRACT

An apparatus for applying lap siding including a main body chassis, a lap siding clamp member, an exposure rod, and a lap siding rest platform. The main body chassis includes a main body base plate with a siding clamp rod support member and a siding backing member positioned opposite and substantially parallel to the siding clamp rod support member. The siding clamp includes a threaded siding clamp rod which adjustably engages the siding clamp rod support member, and has a clamping head attached to its inner end. The exposure rod extends substantially perpendicularly upwardly from the main body base plate. The lap siding rest platform is substantially parallel with the main body base plate and is attached to the exposure rod in a manner adapted to allow for vertical adjustment thereof to a predetermined height above the main body base plate.

6 Claims, 3 Drawing Sheets

70
10
50
44
60
44
52
32
40
30
34
24
42
36
26
42
27
22

APPARATUS AND PROCESS FOR APPLYING LAP SIDING

BACKGROUND OF THE INVENTION

The present invention relates to an apparatus and process for applying lap siding.

In applying lap siding to a structure, a first course is applied to the base of the wall of the structure. The first course is carefully leveled since succeeding courses are attached with their bases separated by a given distance, the distance being selected so that the boards will overlap each other. Each course is mounted by sight, and, therefore, often produces uneven variations between the courses or within a course itself.

Attempts have been made to use mechanical devices to correct the problems that arise using sight for mounting. Some such devices are cumbersome and/or complex, and some can cause damage to the lap siding.

SUMMARY OF THE INVENTION

It is an object of the present invention to provide a lap siding application device which is simple to use and easy to handle.

The application device for applying lap siding includes a main body chassis, a lap siding clamp member, an exposure rod, and a lap siding rest platform.

The main body chassis includes a main body base plate with a siding clamp rod support member and a siding backing member positioned opposite and substantially parallel to the siding clamp rod support member.

The siding clamp includes a threaded siding clamp rod which adjustably engages the siding clamp rod support member, and has a clamping head attached to its inner end.

The exposure rod extends substantially perpendicularly upwardly from the main body base plate.

The lap siding rest platform is substantially parallel with the main body base plate and is attached to the exposure rod in a manner adapted to allow for vertical adjustment thereof to a predetermined height above the main body base plate.

DESCRIPTION OF PREFERRED EMBODIMENTS

Figure 1:
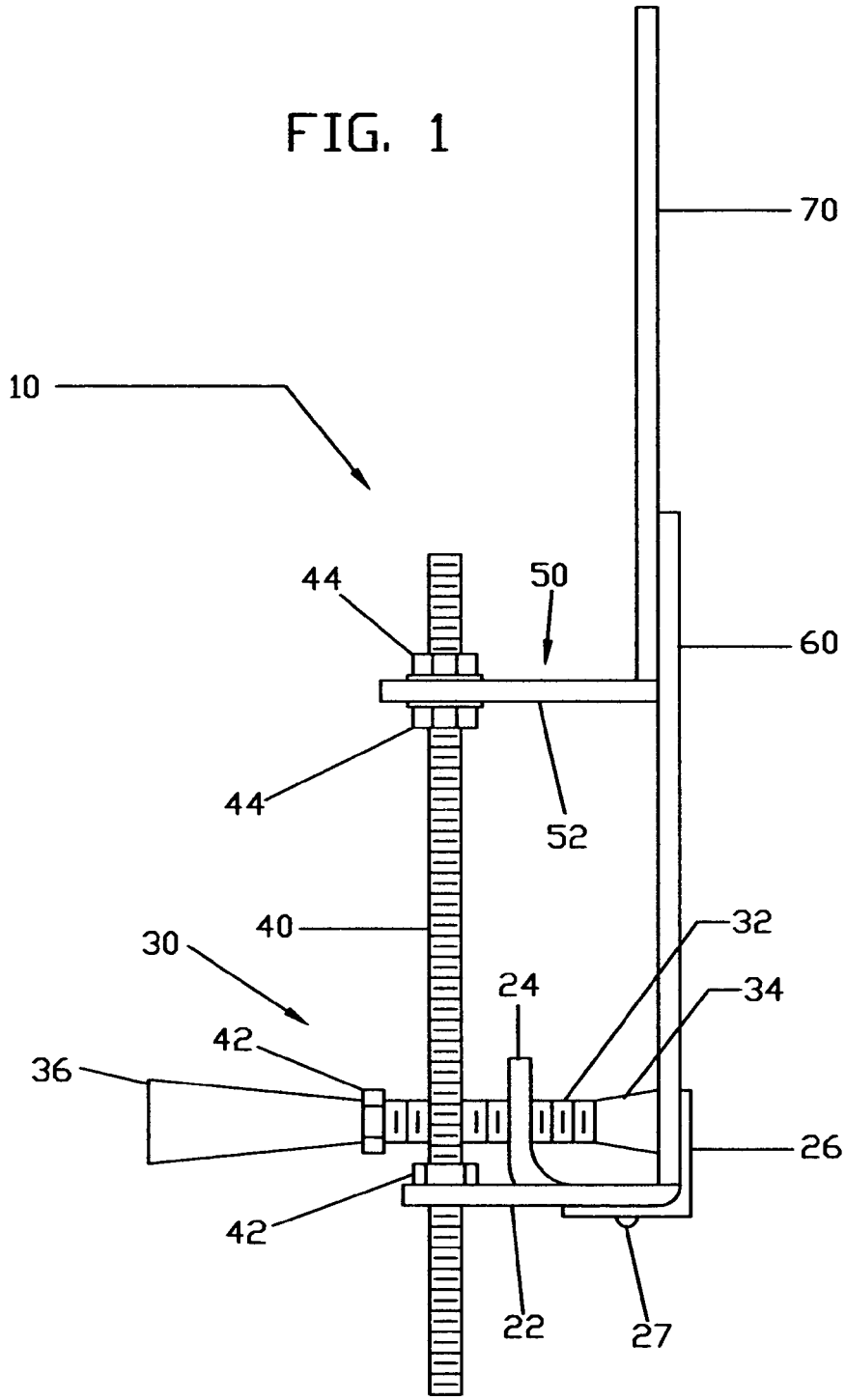
FIG. 1 is a right side elevational view of the device of the present invention.

The apparatus 10 for applying lap siding includes a main body chassis 20, a lap siding clamp member 30, an exposure rod 40, and a lap siding rest platform 50.

Main body chassis 20 includes a base plate 22 having a siding clamp rod support member 24 extending vertically upward from the upper planar surface of base plate 22 and substantially perpendicular thereto. Support member 24 is preferably a cut and bent portion of base plate 22. Alternatively, support member 24 could be a separate member attached to base plate 22, such as by welding. Support member 24 has a threaded opening 25 passing therethrough. Base plate 22 has an opening 23 passing therethrough.

Positioned opposite support member 24 is a siding backing member 26. Siding backing member 26 is L-shaped, with its horizontal leg attached to base plate 22 by threaded fastening member 27.

Lap siding clamp member 30 includes a threaded rod 32 having a clamping head 34 attached to its inner end and a handle 36 attached to its outer end. The threads of threaded rod 32 mate with the threads of opening 25 in clamp rod support member 24, allowing clamping head 34 to be adjusted inwardly and outwardly towards and away from siding backing member 26.

Exposure rod 40 has an upper end and a lower end. The lower end can be threaded through a threaded opening 23 of base plate 22 to allow for vertical adjustment. A nut 42 holds exposure rod 40 tightly in place. Alternatively, exposure rod 40 can be permanently attached to base plate 22, such as by welding.

A lap siding rest platform 50 includes a platform base plate 52 having a slot 54 passing therethrough. The exposure rod 40 is passed through slot 54 and held at its desired height above main body base plate 22 by nuts 44, 44'. Platform base plate 52 is substantially parallel to main body base plate 22.

Figure 2:
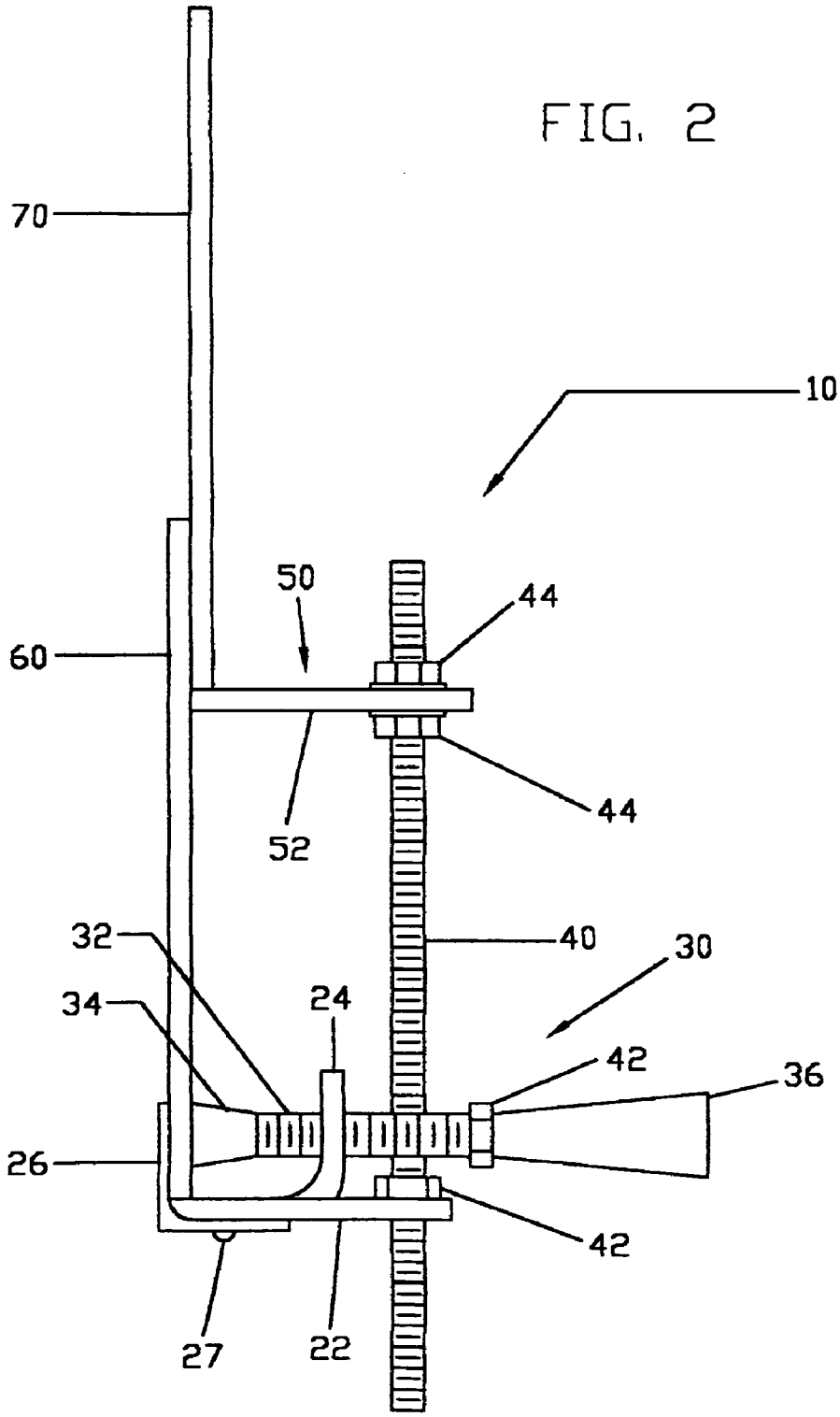
FIG. 2 is a left side elevational view of the device of the present invention.
Figure 3:
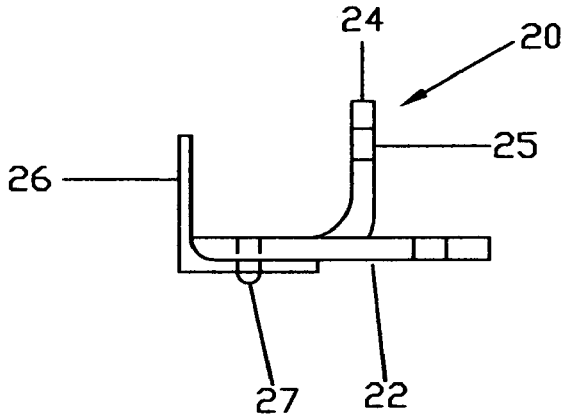
FIG. 3 is a left side elevational view of the main body chassis of the device of the present invention.
Figure 4:
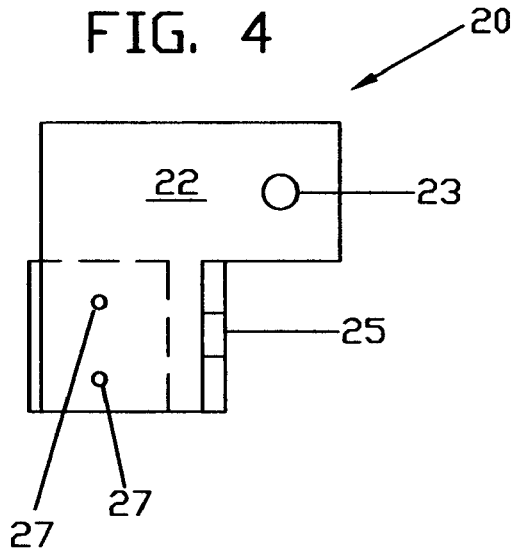
FIG. 4 is a top plan view of the main body chassis of the device of the present invention.
Figure 5:
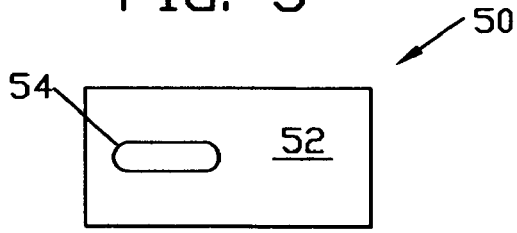
FIG. 5 is a top plan view of the lap siding rest platform of the device of the present invention.

In operation, a first course of siding members 60 (shown in phantom in FIGS. 1 and 2) is carefully attached to a structure (not shown) while being kept level by means of a level measuring device. The vertical leg of L-shaped siding backing member 26 of a first lap siding application device 10 is then slipped behind siding member 60 until the lower edge thereof abuts the upper planar surface of main body base plate 22. Handle 36 of siding clamping member 30 is then turned clockwise to drive clamping head 34 towards the outer surface of siding 60. Enough turning torque is used to tightly engage the inner and outer surfaces of siding member 60 and hold device 10 in place thereon. Siding rest platform 50 is vertically adjusted to a height to provide the desired overlap between the first course of siding members 60 and the next course of siding members 70 (shown in phantom in FIGS. 1 and 2), and horizontally adjusted by horizontal movement of platform 50 along slot 54 so that its inner end will abut siding member 60, as shown.

A second lap siding application device 10 (not shown) is similarly placed a distance from the first lap siding application device 10 to allow a lap siding member 70 to be placed therebetween with its lower edge abutting the upper planar surface of rest platform base plate 52, as shown. Upper course siding member 70 is thus positioned so that it uniformly overlaps lower course siding member 60, and can be fastened into place on the structure.

It will be obvious to those having skill in the art that many changes may be made to the details of the above-described embodiments of this invention without departing from the underlying principles thereof. The scope of the present invention should, therefore, be determined only by the following claims.

The invention claimed is:

1. An apparatus for applying lap siding comprising:

a main body chassis, said main body chassis including a main body base plate, a siding clamp rod support member extending substantially perpendicularly upwardly from said main body base plate, a siding backing member extending substantially perpendicularly upwardly from said main body base plate and positioned opposite and substantially parallel to said siding clamp rod support member;

a siding clamp including a siding clamp rod having a handle attached to its outer end and a clamping head attached to its inner end, said siding clamp rod adapted to engage said siding clamp rod support member in a manner that allows movement of said clamping head towards and away from said siding backing member;

an exposure rod extending from said main body base plate and substantially perpendicular thereto; and a lap siding rest platform having an upper and lower planar surface, the planar surfaces of said lap siding rest platform being substantially parallel with said main body base plate, said lap siding rest platform being movably attached to said exposure rod in a manner adapted to allow for vertical adjustment thereof to a predetermined height above said main body base plate and in a manner adapted to allow for horizontal adjustment.

2. The apparatus of claim 1 wherein said exposure rod is threaded and passes through a slot in said lap siding rest platform, said lap siding platform being held at said predetermined height by first and second nuts threadably attached to said exposure rod, said first nut abutting said upper planar surface of said platform and said second nut abutting said lower planar surface of said platform.

3. The apparatus of claim 2 wherein said exposure rod is permanently attached to said main body base plate.

4. A process for applying lap siding members to a structure, each of said lap siding members having upper and lower edges, comprising:

attaching a first course of lap siding to said structure in a manner such that the lower edges of each of said lap siding members lie along a common horizontal line and are horizontally level;

providing at least two lap siding applicator devices, each of said lap siding applicator devices comprising:

a main body chassis, said main body chassis including a main body base plate having upper and lower planar surfaces, a siding clamp rod support member extending substantially perpendicularly upwardly from said main body base plate, a siding backing member extending substantially perpendicularly upwardly from said main body base plate and positioned opposite and substantially parallel to said siding clamp rod support member;

a siding clamp including a siding clamp rod having a handle attached to its outer end and a clamping head attached to its inner end, said siding clamp rod adapted to engage said siding clamp rod support member in a manner that allows movement of said clamping head towards and away from said siding backing member;

an exposure rod extending from said main body base plate and substantially perpendicular thereto; and a lap siding rest platform having an upper and lower planar surface, the planar surfaces of said lap siding rest platform being substantially parallel with said main body base plate, said lap siding rest platform being movably attached to said exposure rod in a manner adapted to allow for vertical adjustment thereof to a predetermined height above said main body base plate and in a manner adapted to allow for horizontal adjustment;

attaching at least two lap siding applicator devices to the first course of lap siding by inserting the bottom edge of a lap siding member of said first course of lap siding into the space between said siding backing member and said siding clamp rod support member with said bottom edge being in abutment with the upper planar surface of said main body base plate, and moving said clamping head inwardly into locking abutment with said lap siding member;

adjusting the vertical distance between the upper planar surface of said main body base plate and said lap siding rest platform by moving said platform upwardly or downwardly along said exposure rod to provide the desired overlap spacing between said first course of lap siding and a second course to be applied;

said at least two lap siding applicator devices being spaced apart a distance adapted to support a lap siding member on the upper planar surface of said lap siding rest platform; and attaching said lap siding member supported by said lap siding applicator devices to the structure.

5. The process of claim 4 wherein said exposure rod is threaded and passes through a slot in said lap siding rest platform, said lap siding platform being held at said predetermined height by first and second nuts threadably attached to said exposure rod, said first nut abutting said upper planar surface of said platform and said second nut abutting said lower planar surface of said platform.

6. The process of claim 5 wherein said exposure rod is permanently attached to said main body base plate.

* * * * *